US010842302B1

(12) United States Patent
Salles, Jr. et al.

(10) Patent No.: US 10,842,302 B1
(45) Date of Patent: Nov. 24, 2020

(54) SPILL RESISTANT CUP WITH COOLING CHAMBER

(71) Applicant: No Spill Technologies, LLC, Slidell, LA (US)

(72) Inventors: David Christopher Salles, Jr., Slidell, LA (US); Armond Albert Kaiser, Diamondhead, MS (US); Steven Swisher, Tulsa, OK (US)

(73) Assignee: NO SPILL TECHNOLOGIES, LLC, Slidell, LA (US)

( * ) Notice: Subject to any disclaimer, the term of this patent is extended or adjusted under 35 U.S.C. 154(b) by 389 days.

(21) Appl. No.: 15/634,606

(22) Filed: Jun. 27, 2017

Related U.S. Application Data

(63) Continuation-in-part of application No. 14/657,108, filed on Mar. 13, 2015, now Pat. No. 9,895,015, (Continued)

(51) Int. Cl.

| | |
|---|---|
| ***A47G 19/22*** | (2006.01) |
| ***B65D 43/02*** | (2006.01) |
| ***B65D 47/32*** | (2006.01) |
| ***B65D 25/04*** | (2006.01) |
| ***B65D 81/38*** | (2006.01) |

(52) U.S. Cl.
CPC ..... *A47G 19/2261* (2013.01); *A47G 19/2272* (2013.01); *A47G 19/2288* (2013.01); *B65D 25/04* (2013.01); *B65D 43/0212* (2013.01); *B65D 43/0231* (2013.01); *B65D 47/32* (2013.01); *B65D 81/3865* (2013.01); (Continued)

(58) Field of Classification Search
CPC ..... B65D 43/0212; B65D 43/0206; B65D 51/16; B65D 51/1611; B65D 51/18; B65D 47/06; B65D 81/262; B65D 2251/0025; B65D 2251/0056; B65D 2251/0087; B65D 2543/00046; B65D 2543/00092; A61J 11/008; A61J 11/04; A61J 11/045; A47G 19/22; A47G 19/2211; A47G 19/2266; A47G 19/2272; G01F 11/262
USPC ... 220/371–372, 501, 592.17, 703, 709, 711, 220/713–714, 716, 719; 215/11.1, 215/11.4–11.6, 229, 379, 382–384; D7/510–511; D9/428, 430–432
See application file for complete search history.

(56) References Cited

U.S. PATENT DOCUMENTS

| | | | |
|---|---|---|---|
| 2,143,027 | A | 8/1935 | Perry |
| 2,278,586 | A | 5/1940 | Potter |

(Continued)

FOREIGN PATENT DOCUMENTS

| | | |
|---|---|---|
| CN | 202445711 | 9/2012 |

*Primary Examiner* — Chun Hoi Cheung
*Assistant Examiner* — Brijesh V. Patel
(74) *Attorney, Agent, or Firm* — Head, Johnson, Kachigian & Wilkinson, PC

(57) ABSTRACT

A spill resistant cup comprising: a substantially hollow body; a lid, where the lid is removably attached to the body such that the lid spans the top of the body and where the top of the lid has an opening; and an insert located between and spaced from the top of the lid and the bottom of the body, where the insert has an elevated opening and where the opening in the insert aligns with the opening in the lid. The insert, along with the alignment of the openings, allows a user to drink from the cup unimpeded while preventing liquid from within the cup from spilling out in significant quantities when the cup is tipped over.

13 Claims, 15 Drawing Sheets

Related U.S. Application Data which is a continuation-in-part of application No. 14/211,365, filed on Mar. 14, 2014, now abandoned.

(60) Provisional application No. 61/790,803, filed on Mar. 15, 2013.

(52) U.S. Cl.
CPC ..... *B65D 2543/00046* (2013.01); *B65D 2543/00537* (2013.01); *B65D 2543/00777* (2013.01)

(56) References Cited

U.S. PATENT DOCUMENTS

| | | | |
|---|---|---|---|
| 2,414,697 | A | 9/1945 | Pettersson |
| 2,597,522 | A | 12/1947 | Pierce |
| 2,529,114 | A | 11/1950 | Tellier |
| 3,040,897 | A | 6/1962 | Holman |
| 4,130,215 | A | 12/1978 | Corey et al. |
| 4,146,157 | A | 3/1979 | Dixon, Sr. et al. |
| 4,388,996 | A | 6/1983 | Panicci |
| 4,441,640 | A | 4/1984 | Lottick |
| 4,574,970 | A | 3/1986 | Schwarz |
| 4,986,437 | A | 1/1991 | Farmer |
| D320,455 | S | 10/1991 | Malcolm |
| 5,150,800 | A | 9/1992 | Sailer et al. |
| 5,454,482 | A | 10/1995 | Simon |
| D364,315 | S | 11/1995 | Humphrey et al. |
| 5,560,513 | A | 10/1996 | Jarrell |
| 5,593,891 | A | 1/1997 | Banes |
| 5,704,510 | A | 1/1998 | Feltman, III et al. |
| D399,392 | S | 10/1998 | Husted |
| 5,890,621 | A | 4/1999 | Bachman et al. |
| 5,894,952 | A | 4/1999 | Mendenhall et al. |
| 5,938,053 | A | 8/1999 | Verbovszky et al. |
| 6,065,635 | A | 5/2000 | Sullivan |
| D452,415 | S | 12/2001 | McDonough et al. |
| D461,097 | S | 8/2002 | Nemirovsky |
| 6,571,973 | B1 | 6/2003 | Tripsianes |
| 6,626,314 | B1 | 9/2003 | McHenry et al. |
| 6,705,485 | B1 | 3/2004 | Sato et al. |
| 7,073,678 | B1 | 7/2006 | Dibdin et al. |
| 7,198,167 | B2 | 4/2007 | Marsden et al. |
| 7,314,136 | B2 | 1/2008 | Stefandl |
| D589,752 | S | 4/2009 | Fetting |
| D603,219 | S | 11/2009 | Lopez |
| D623,941 | S | 9/2010 | Bendix |
| 8,061,197 | B2 | 11/2011 | Silvers |
| 2002/0003145 | A1 | 1/2002 | Milan |
| 2002/0139767 | A1 | 10/2002 | Budd |
| 2003/0019876 | A1 | 1/2003 | Burke et al. |
| 2004/0200845 | A1 | 10/2004 | Watzke et al. |
| 2004/0232154 | A1 | 11/2004 | Smith et al. |
| 2005/0072787 | A1 | 4/2005 | Morris et al. |
| 2005/0167439 | A1 | 8/2005 | Chandler et al. |
| 2006/0169694 | A1 | 8/2006 | Kemper |
| 2007/0145058 | A1 | 6/2007 | Connors, Jr. et al. |
| 2007/0187406 | A1 | 8/2007 | Nobile et al. |
| 2008/0128438 | A1 | 6/2008 | Lane |
| 2008/0156817 | A1 | 7/2008 | Roseblade et al. |
| 2008/0264960 | A1 | 10/2008 | Phillips et al. |
| 2009/0108003 | A1 | 4/2009 | Tripsianes |
| 2010/0018975 | A1 | 1/2010 | DeMarco |
| 2010/0112146 | A1 | 5/2010 | Zoss |
| 2010/0155403 | A1 | 6/2010 | Gold et al. |
| 2010/0193459 | A1 | 8/2010 | Housley |
| 2010/0294764 | A1 | 11/2010 | Kemper et al. |
| 2011/0079570 | A1 | 4/2011 | Brown et al. |
| 2011/0309093 | A1 | 12/2011 | Buck |
| 2012/0037669 | A1 | 2/2012 | Goetz et al. |
| 2012/0187066 | A1 | 7/2012 | Redl |

SPILL RESISTANT CUP WITH COOLING CHAMBER

CROSS REFERENCE

This application is based on and claims priority to U.S. Application No. 61/790,803 filed Mar. 15, 2013, U.S. application Ser. No. 14/211,365 filed Mar. 14, 2014, and U.S. application Ser. No. 14/657,108 filed Mar. 13, 2015, which are incorporated herein by reference.

BACKGROUND OF THE INVENTION

Field of the Invention

This invention relates generally to a cup, and more particularly, but not by way of limitation, to a spill resistant transition cup.

Description of the Related Art

The transition from baby bottles to drinking from a regular cup is difficult for children. The mechanism of drinking is different, and a cup must be held more carefully than a baby bottle to prevent spills. Many children stop drinking from baby bottles before they have the dexterity necessary to drink from a cup without spilling its contents. One common solution is the sippy cup. A sippy cup typically has a lid with a spout and a valve, through which the contents of the cup may be drunk. The valve helps prevent spills should the sippy cup tip over.

The valve forces a user to suck on the spout, making the mechanism of drinking from a sippy cup similar to that of drinking from a baby bottle. The sucking process can also cause excruciating inner ear pain in children that are experiencing sinus congestion and/or infections. The valve is often made of silicone or a similar substance that must be separately washed. Washing a valve may be quite difficult due to its shape, and thus sippy cup valves are frequently less than ideally clean and often require regular replacement. Constantly sucking on sippy cup spouts may adversely affect the development of a child's teeth and mouth. Similarly, chewing on a sippy cup spout, as often happens, may not be healthy for the child. The use of a sippy cup may also discourage a child from learning how to properly drink from a regular cup, as the sippy cup may be held at any angle while drinking without spilling.

Other populations would likewise benefit from a cup that is spill resistant, such as the elderly and those with dexterity issues.

Based on the foregoing, it is desirable to provide an alternative to the sippy cup that provides a proper transition from a baby bottle to a standard drinking cup.

It is further desirable to provide a cup that simulates the feeling of drinking from a regular cup while providing some spill resistance.

It is further desirable to provide a spill resistant cup that does not have a valve.

It is further desirable to provide a spill resistant cup that encourages children to learn how to hold a cup properly while drinking from it to prevent spills.

It is further desirable to provide a spill resistant cup that may be used by adults drinking hot beverages that allows a small portion of the beverage to cool while keeping the remainder of the beverage hot.

SUMMARY OF THE INVENTION

In general, in a first aspect, the invention relates to a spill resistant cup comprising: a substantially hollow body with a top and a bottom, where the bottom of the body is closed and the top of the body is open; a lid with a top and at least one side wall, where the lid is removably attached to the body such that the lid spans the top of the body and where the top of the lid has an opening; and an insert located between and spaced from the top of the lid and the bottom of the body, where the insert has an elevated opening.

The body may have one or more flat panels such that when the cup tips over it tends to rest on one of the one or more flat panels. The opening in the lid may not align with any of the one or more flat panels of the body. The body may have a rim adjacent the top, the lid may have a rim, and the lid may removably attach to the body via the two rims. At least one sidewall of the lid may comprise the rim of the lid. The rim of the body may have a tab and the rib of the lid may have a corresponding recess such that the lid may be removably attached to the body in only one orientation. The rim of the body may have threads and the rim of the lid may have corresponding threads such that the lid may be screwed onto the body. The body may have one or more flat panels such that when the cup tips over it tends to rest on one of the one or more flat panels and the at least one sidewall of the lid may have one or more flat portions aligned with the one or more flat panels of the body. The spill resistant cup may further comprise a trough located adjacent the opening in the lid such that liquid must travel along the trough to exit the cup via the opening in the lid. The opening in the insert may align with the opening in the lid. The lid may further comprise a vent hole. The insert may further comprise a vent hole. The insert may be removably attached to the lid or may be integral to the lid. The spill resistant cup may further comprise a hood located between the opening in the insert and the opening in the lid. The spill resistant cup may further comprise one or more posts extending downward from the insert.

In a second aspect, the invention relates to a spill resistant cup comprising: a substantially closed vessel with an interior shape defining an interior space, where the vessel has a top and an opposing bottom, and where the vessel is shaped such that it has one or more predictable landing positions, where a landing position is a position in which the cup comes to rest when placed on a surface other than on its bottom; an opening in the top of the vessel, where the opening is positioned such that it is not down when the cup is in any of the predictable landing positions; and an insert between the top and the bottom of the vessel with an elevated opening, where the insert has a perimeter matching the interior shape of the vessel at the location of the insert such that liquid cannot travel past the insert other than through the opening in the insert.

In a third aspect, the invention relates to a spill resistant cup comprising: a substantially hollow body with a top and a bottom; an insert located between and spaced from the top and the bottom of the body, such that the insert divides the body into a lower chamber and an upper chamber; and at least one elevated opening in the insert, such that liquid in the lower chamber travels to the upper chamber when the cup is tipped and is retained in the upper chamber when the cup is returned to an upright position. The lower chamber may be insulated, while the upper chamber may not be insulated.

and

Figure 27:
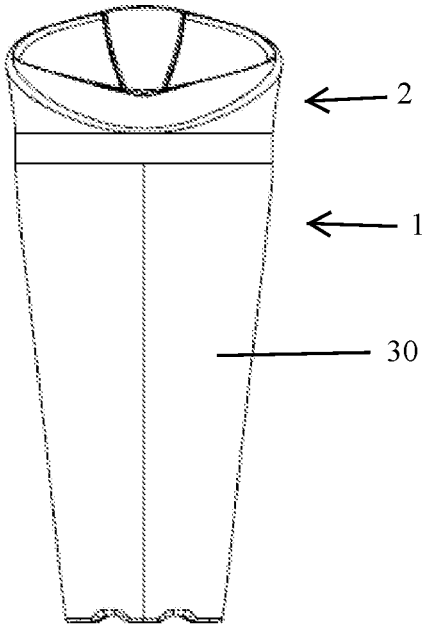
Figure 28:
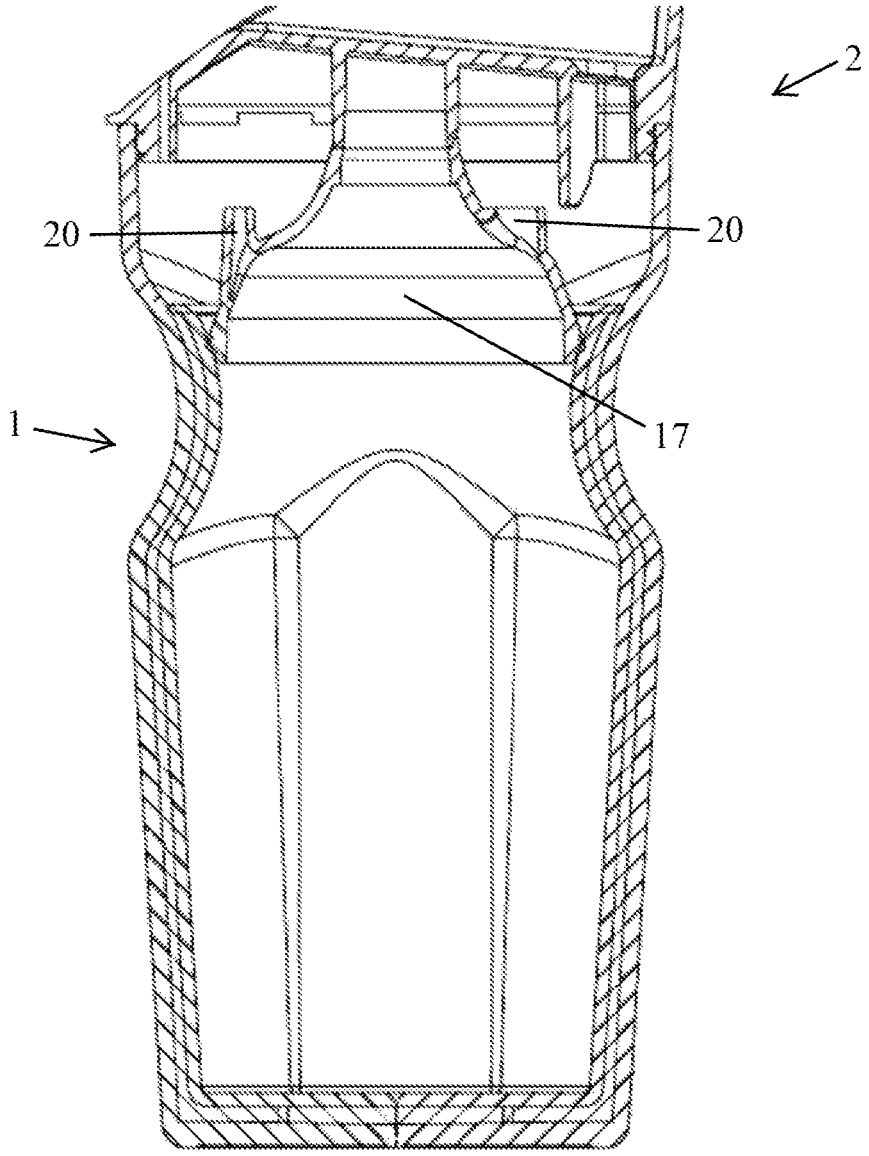

FIG. 27 is a rotated side view of the spill resistant cup with spray insulation in place.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

Figure 1:
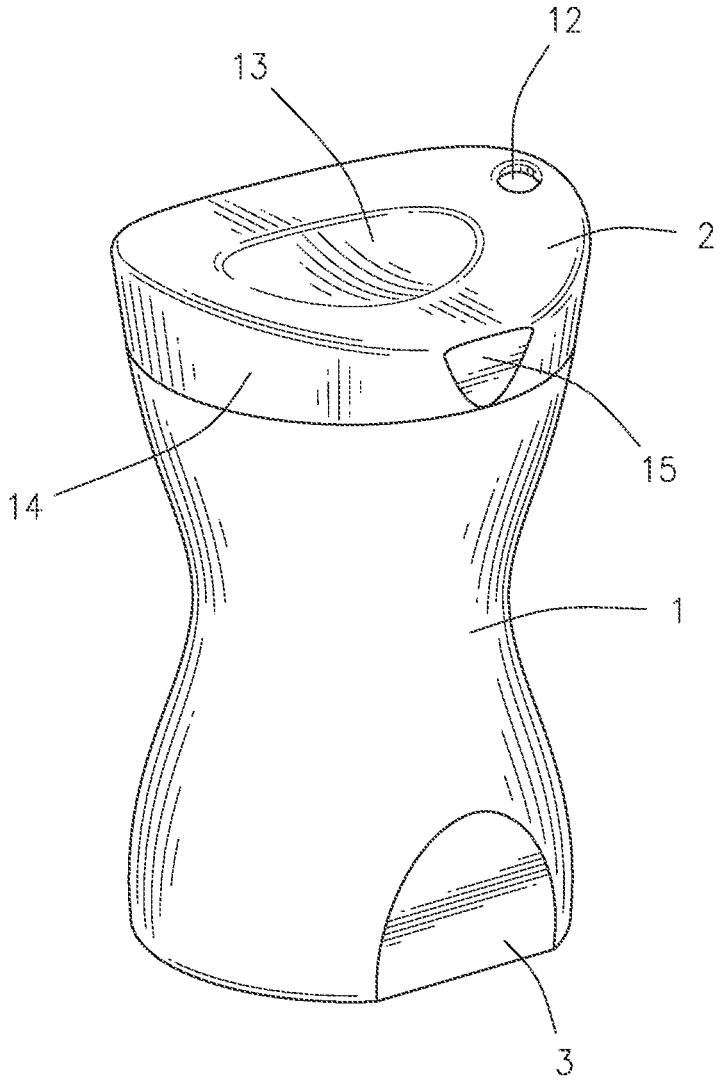
FIG. 1 is a perspective view of the spill resistant cup.
Figure 4:
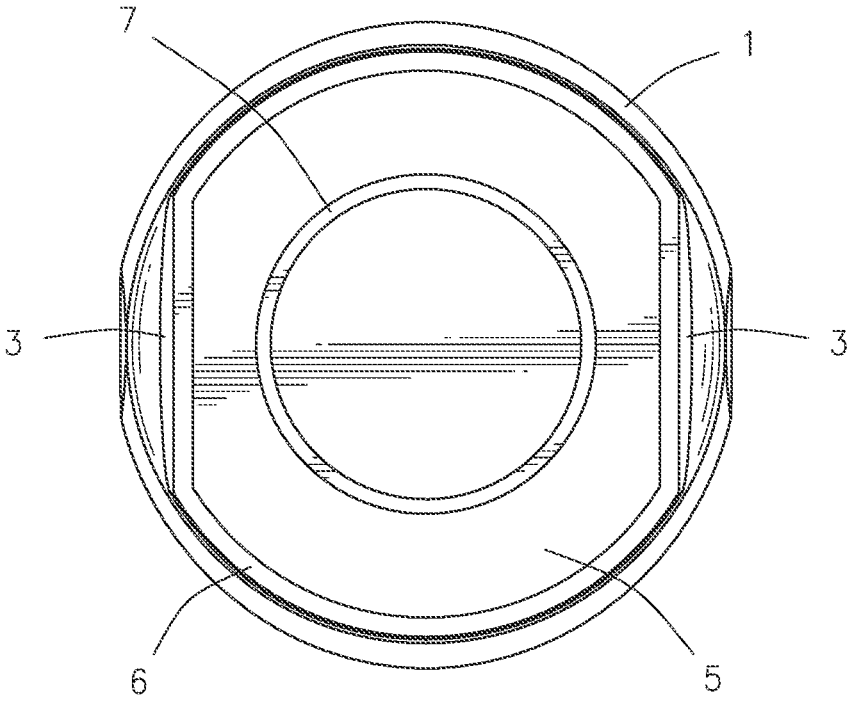
FIG. 4 is a bottom view of the spill resistant cup.
Figure 5:
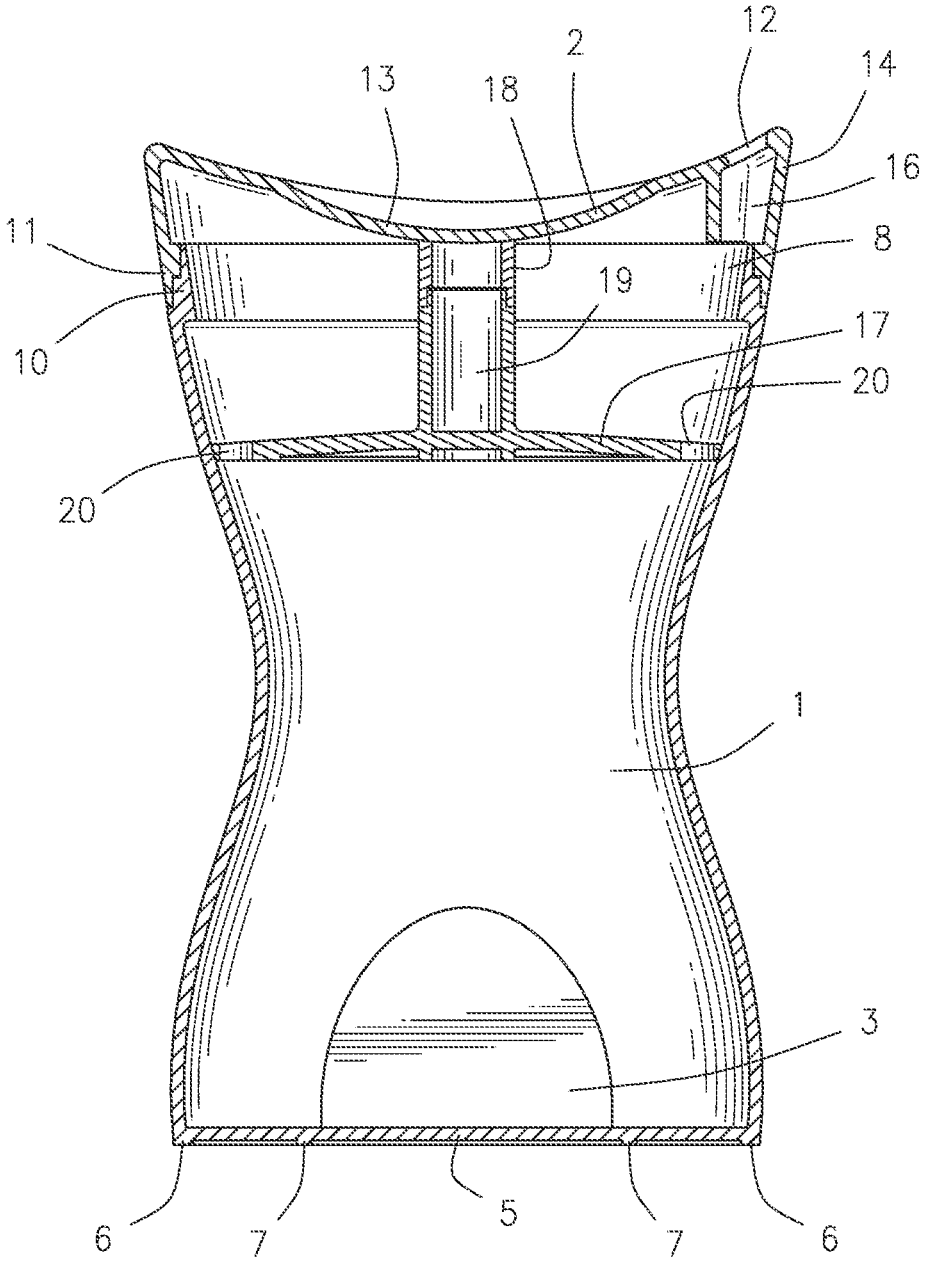
FIG. 5 is a cut away view of the spill resistant cup.
Figure 24:
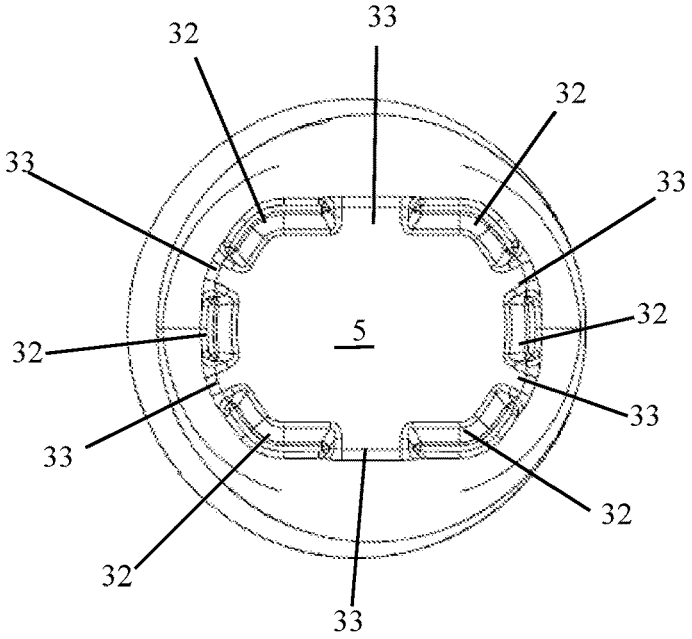
FIG. 24 is a bottom view of the spill resistant cup.
Figure 25:
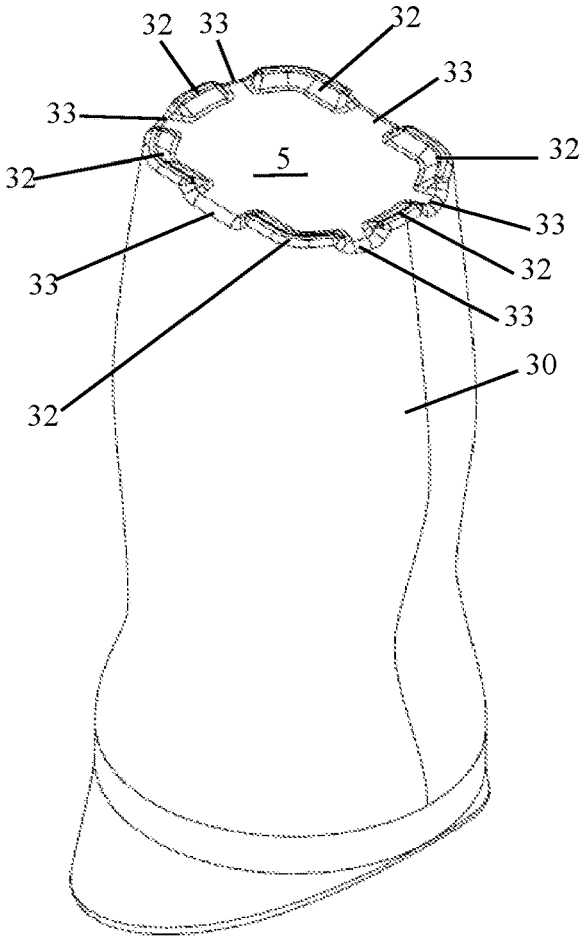
FIG. 25 is a perspective view of the spill resistant cup turned upside down.

In general, in a first aspect, the invention relates to a spill resistant cup with a body 1 and a lid 2, as seen in FIG. 1. The body 1 may be hollow, such that it may hold fluid for drinking. The body 1 may be at least partially curved, and may have at least one flat portion 3 to encourage the spill resistant cup to settle on the flat portion 3 if tipped over. Alternately, the flat portion 3 may not be flat, but may be substantially flat, gently curved, or curved. The body 1 may be generally cylindrical or may have an hourglass shape, as shown, or any other desired shape. For example, the body 1 may be an elliptic cylinder or other cylinder with a non-circular cross section, such as an oval cross section. If so, the flat portion 3 may not be flat, but may be merely an area along the existing curve of the cylinder. The body 1 may have an open top 4 and a closed bottom 5. The bottom 5 may be generally flat, and may have a protrusion 6 along its edge and/or a circular protrusion 7 on its face, as shown in FIGS. 4 and 5. As shown in FIGS. 24 and 25, the bottom 5 may be generally flat with one or more protrusions 32 along its edge such that the cup rests on the protrusions 32. The protrusions 32 may be interspersed with one or more notches 33, which may allow fluid to escape the protrusions 32 when the cup is inverted, such as in a dishwasher.

Figure 12:
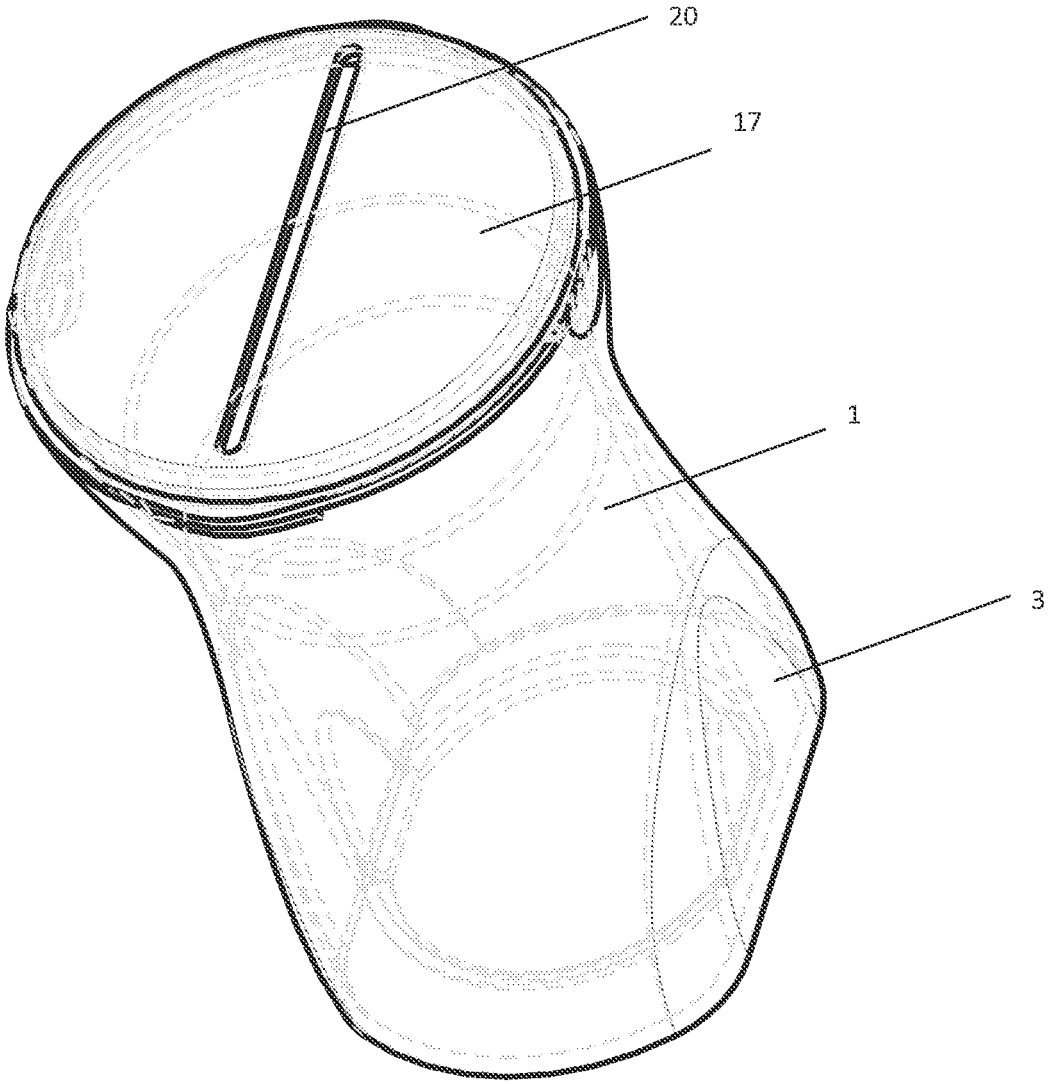
FIG. 12 is a perspective view of the spill resistant cup with insulation and an alternate insert design.
Figure 26:
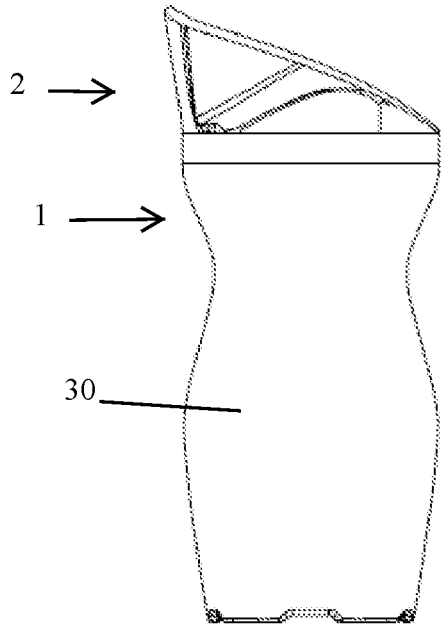
FIG. 26 is a side view of the spill resistant cup with spray insulation in place.

The body 1 may optionally be at least partially insulated, as shown in FIG. 12. Optionally, the cup may comprise a separate insulator 30. The insulator 30 may be a discreet structure or, alternately, may be sprayed onto the body 1 to form a permanent layer thereof, as shown in FIG. 26. The body 1 may have a recess 34 into which the insulator 30 fits, providing for an uninterrupted outer surface when the cup is assembled with the insulator 30 in place on the body 1. The insulator 30 may extend fully or partly up the sides of the body 1. For example, the insulator 30 may extend approximately ¼, ⅓, ½, ⅔, ¾, or all the way up the sides of the body 1. The insulator 30 may extend sufficiently high to prevent the heat of a user's hand holding the cup from melting ice therein.

The body 1 may have a rim 8 extending upward adjacent its open top 4. The lid 2 may have a corresponding rim 9 extending downward, such that lid 2 may attach to the body 1 along the rims 8 and 9. Rim 8 may have a tab 10 and rim 9 may have a corresponding recess 11, ensuring that the lid 2 is placed on the body 1 in a desired orientation. In general, it is desirable for the flat portion 3 not to align with any opening in the lid 2 to minimize the possibility of liquid escaping the spill resistant cup if it tips over and comes to rest on the flat portion 3. The tab 10 and recess 11 may be oriented such that the flat portion 3 is 90° from the opening 12 in the lid 2, as shown.

The rims 8 and 9 may form a twist lock, such that the lid 2 may be placed on the body 1 and twisted a short distance, causing the twist lock to engage, thus preventing the lid 2 from being removed from the body 1 without untwisting. Alternately, the rims 8 and 9 may be threaded such that they may be joined to each other by twisting. Alternately, the rims 8 and 9 may join together through a friction fit. Alternately, the rims 8 and 9 may snap together. Alternately, the rims 8 and 9 may have any other appropriate mechanism for attaching to one another such that the lid 2 may be secured to the body 1 via the rims 8 and 9. The spill resistant cup may have a gasket located at the rims 8 and 9 to prevent leakage of fluid from the cup.

Figure 6:
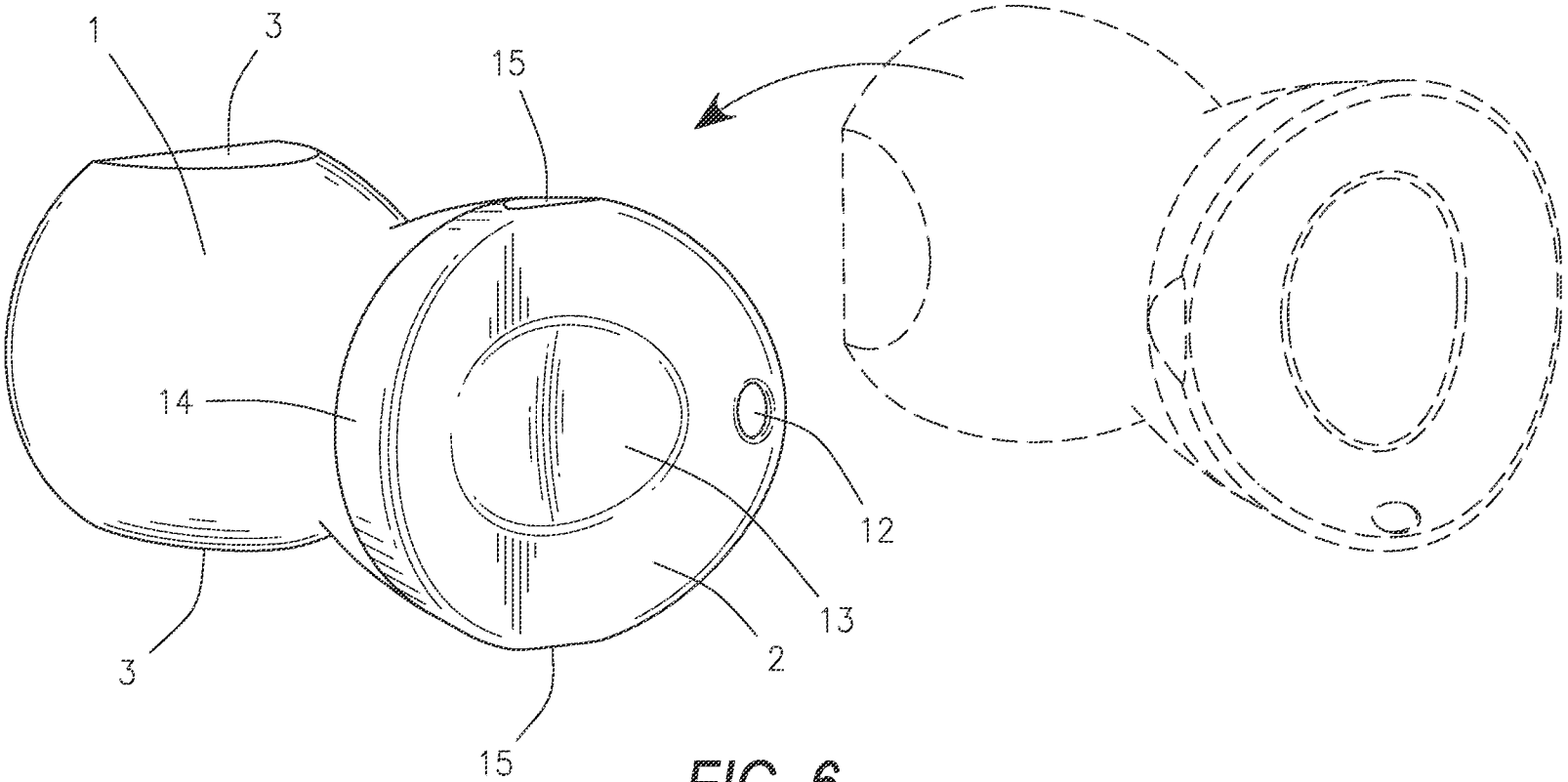
FIG. 6 is a perspective view of the spill resistant cup, showing the cup landing on its front and coming to rest on its side.
Figure 7:
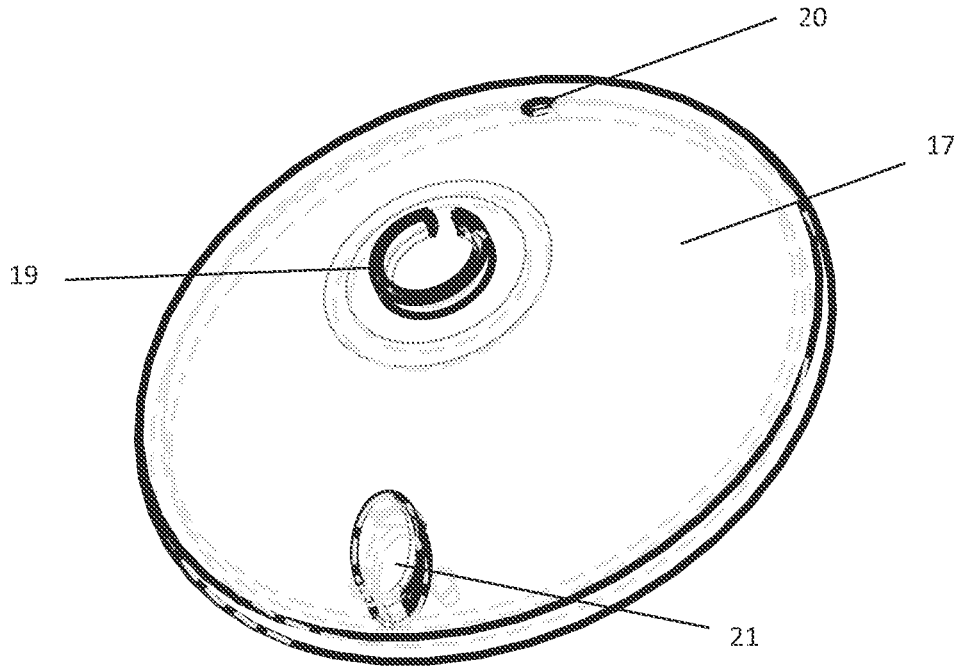
FIG. 7 is a perspective view of an alternate insert design.
Figure 8:
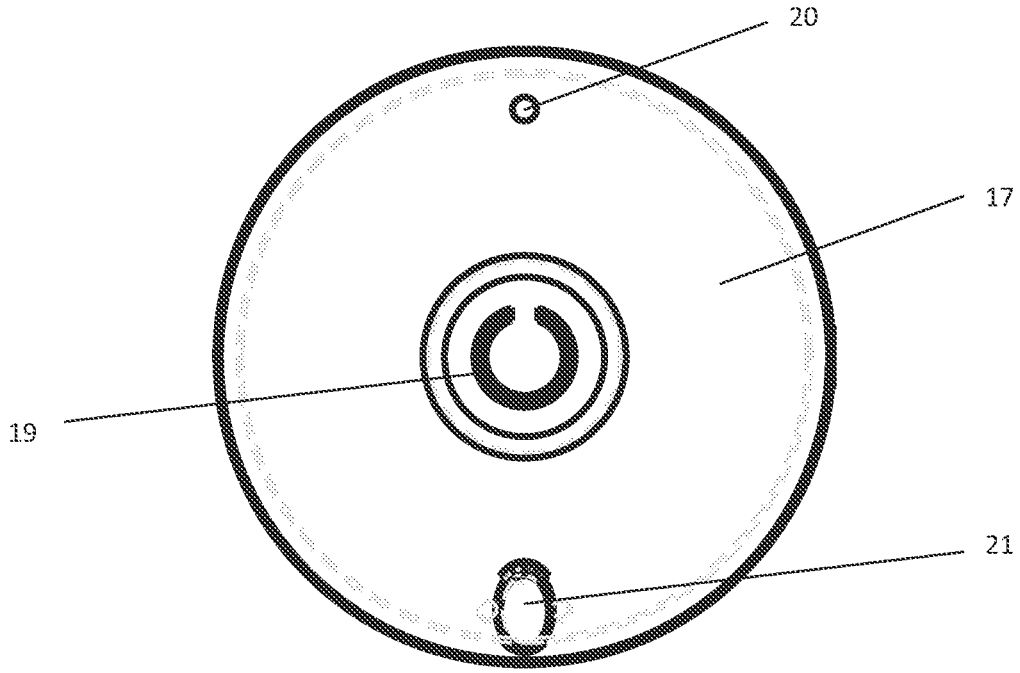
FIG. 8 is a top view of the alternate insert design.
Figure 9:
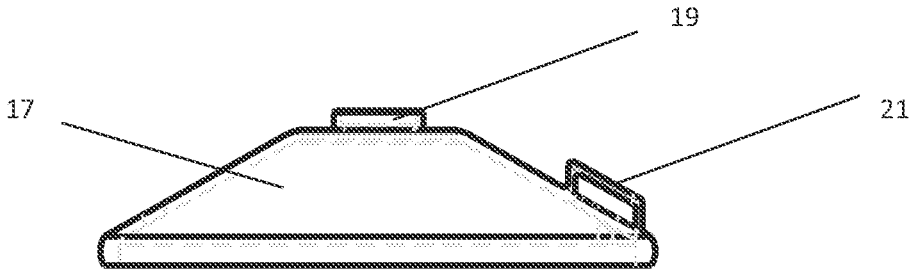
FIG. 9 is a side view of the alternate insert design.
Figure 10:
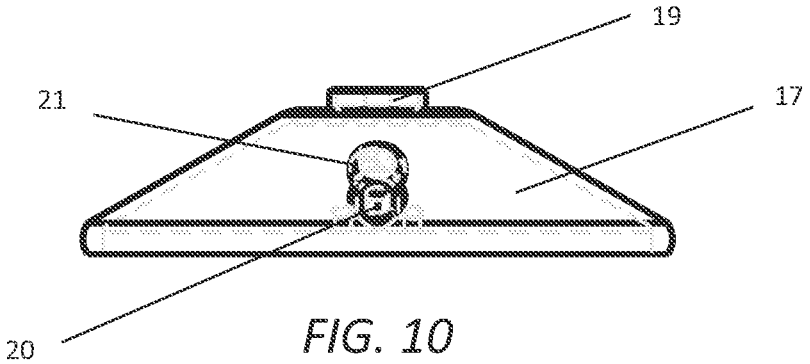
FIG. 10 is a front view of the alternate insert design.
Figure 11:
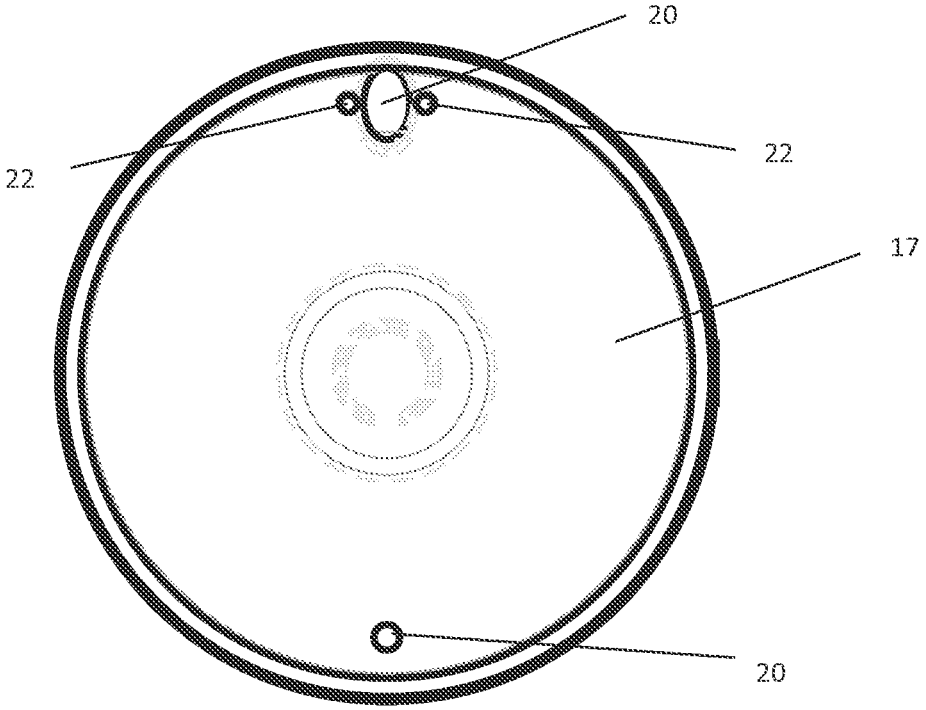
FIG. 11 is a bottom view of the alternate insert design.
Figure 13:
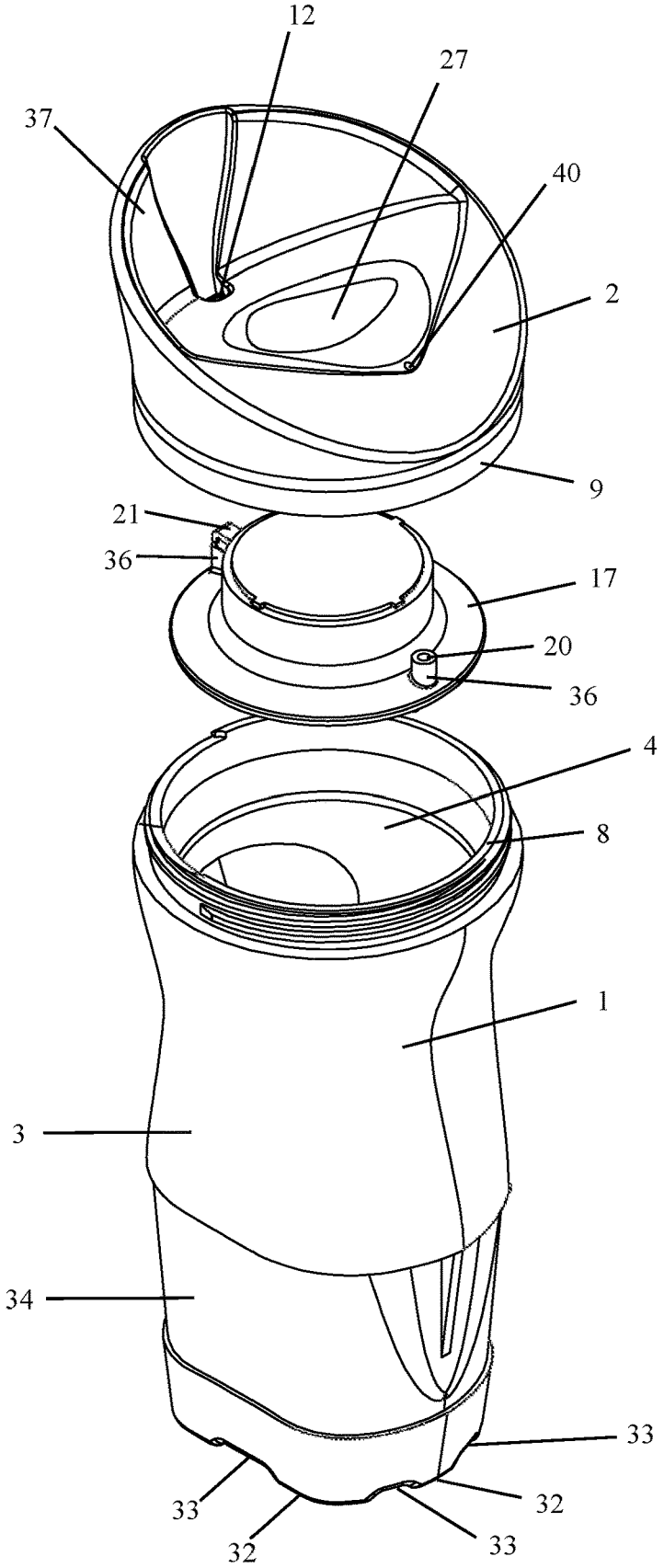
FIG. 13 is an exploded perspective view of an alternate version of the spill resistant cup.
Figure 14:
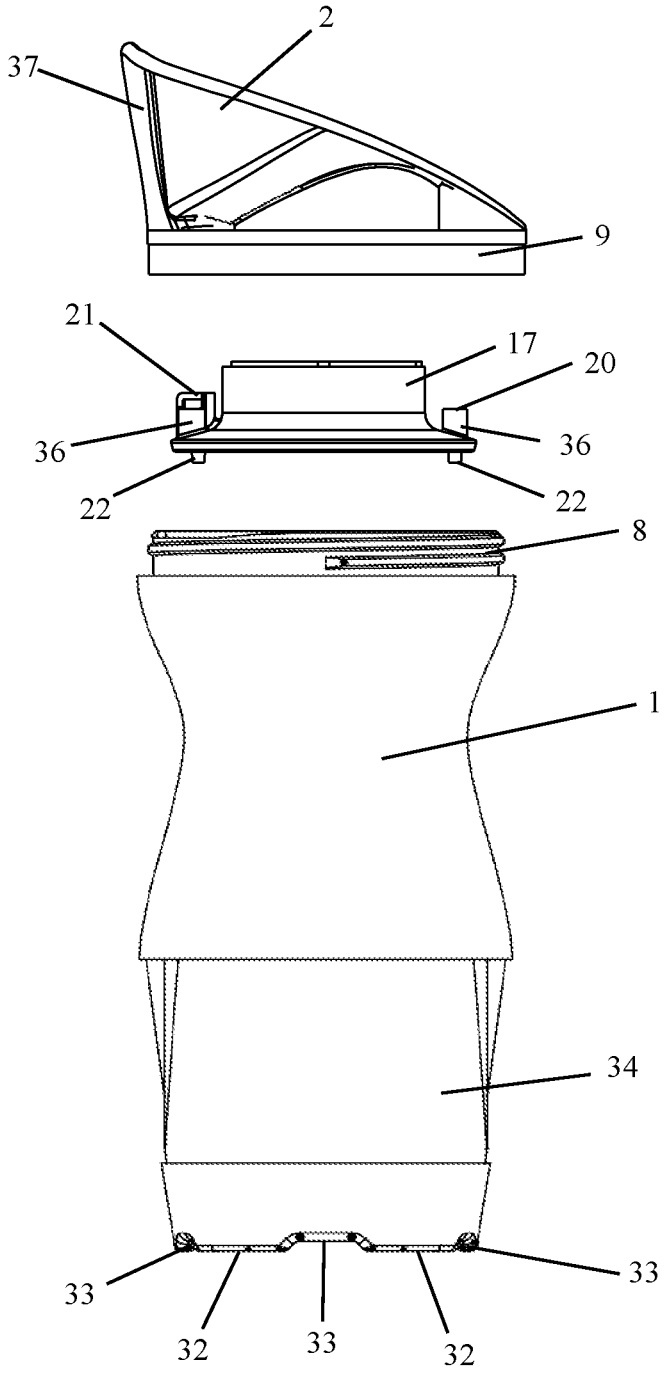
FIG. 14 is a side exploded perspective view of the alternate version of the spill resistant cup.
Figure 15:
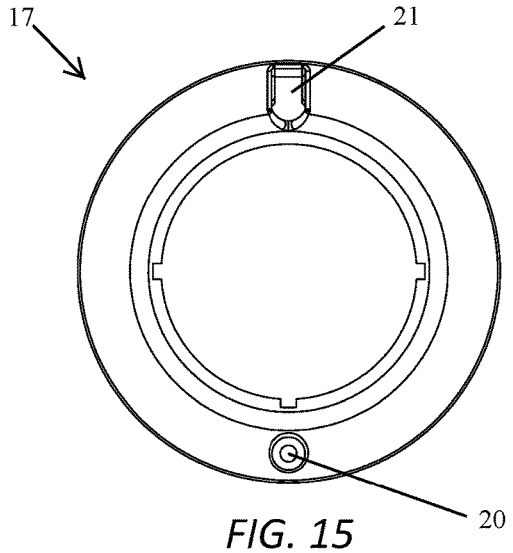
FIG. 15 is a top view of a second alternate insert design, as used in the alternate version of the spill resistant cup.
Figure 16:
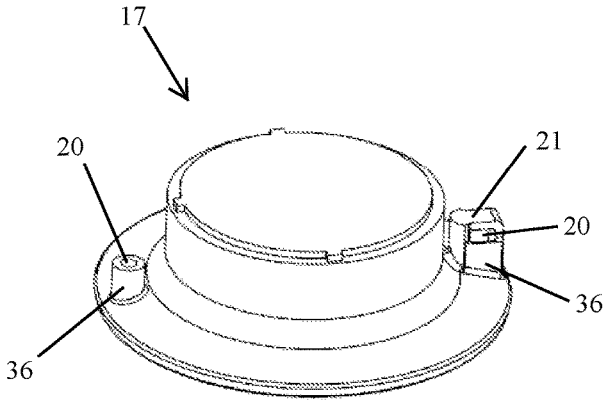
FIG. 16 is a perspective view of the second alternate insert design.
Figure 17:
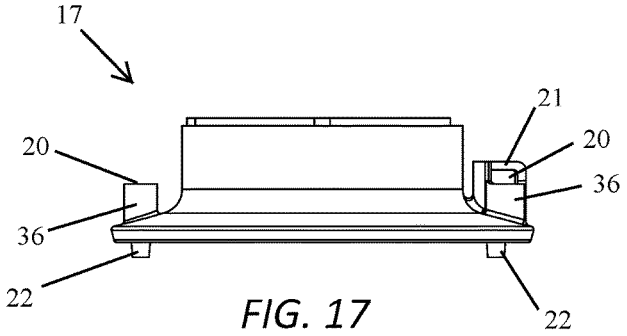
FIG. 17 is a side view of the second alternate insert design.
Figure 18:
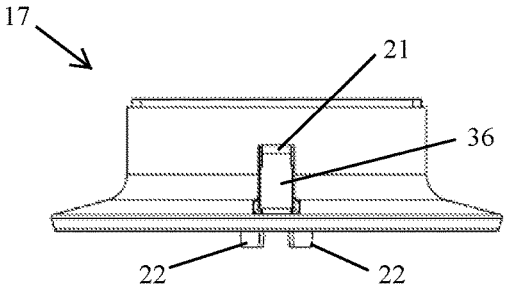
FIG. 18 is a 90° rotated side view of the second alternate insert design.
Figure 19:
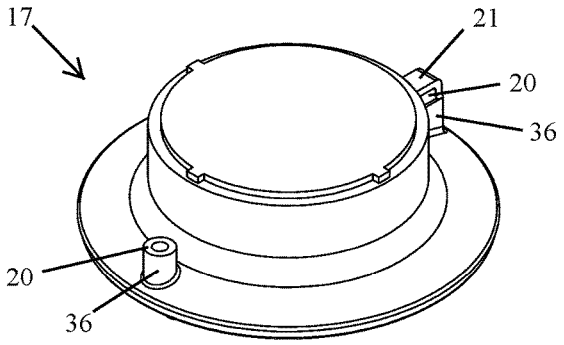
FIG. 19 is a 45° rotated perspective view of the second alternative insert design.
Figure 20:
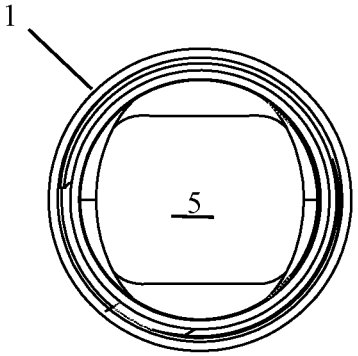
FIG. 20 is a top view of the body of the alternate version of the spill resistant cup.
Figure 21:
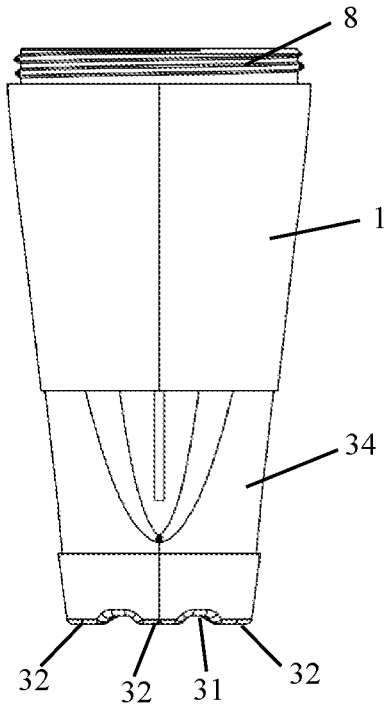
FIG. 21 is a side view of the body of the alternate version of the spill resistant cup.
Figure 22:
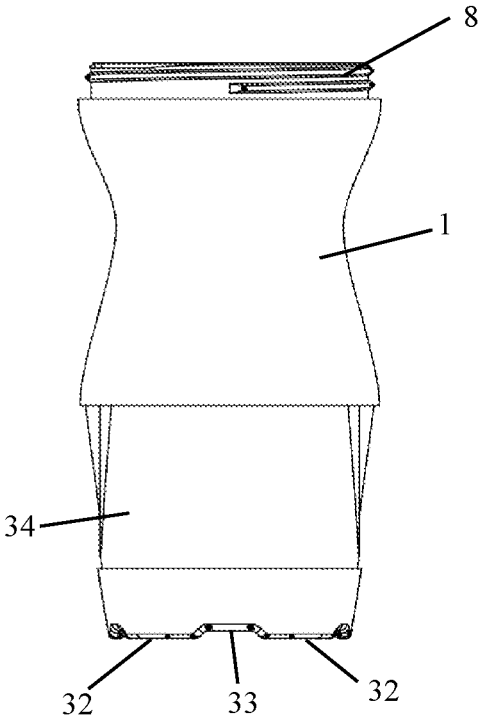
FIG. 22 is a 90° rotated side view of the body of the alternate version of the spill resistant cup.
Figure 23:
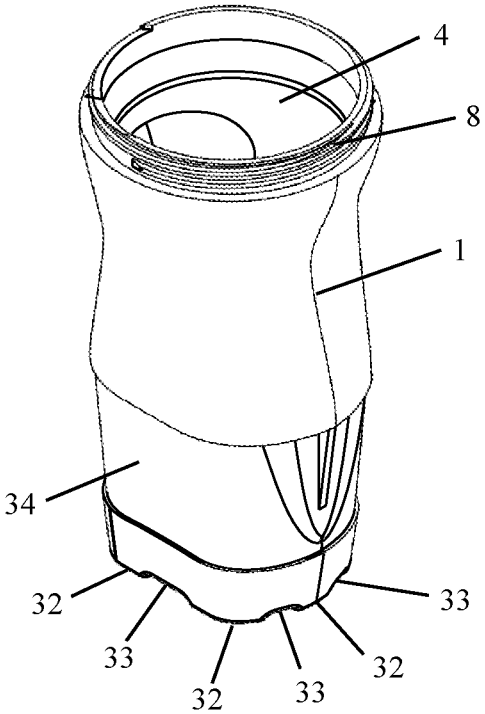
FIG. 23 is a perspective view of the body of the alternate version of the spill resistant cup.

The lid 2 may have an opening 12 through which liquid in the cup may be drunk by a user. The opening 12 may be circular or oval-shaped, as shown in FIGS. 1 through 3 and 6, or any other desired shape. A vent hole 40 may be located in the lid 2 opposite the opening 12. The lid 2 may be saddle-shaped or, more particularly, shaped like a truncated hyperbolic paraboloid, as shown. This shape may make it difficult for the cup to rest upside down on the lid 2, encouraging the cup to rest on its side if dropped. Alternately, the lid 2 may have an extended lip 37 located along its edge near the opening 12, where the extended lip 3727 is taller than the edge of the lid 2 elsewhere, as shown in FIGS. 13 and 14. With this shape, if the cup lands on its lid 2, fluid inside may be angled away from the opening 12. Alternately, the lid may have any other desired shape. The lid 2 may have a center depression 13, which may be oval-shaped. The lid 2 may have a generally vertical side wall 14, which may be generally curved. The side wall 14 may have at least one flat portion 15, which may align with the at least one flat portion 3 to further encourage the cup to rest along these flat portions 3 and 15 when tipped over, as shown in FIG. 6. Again, the flat portion 15 may or may not be actually flat, depending on the geometry of the lid 2. The flat portion 15 may not align with the opening 12. The opening 12 may be located at a point 90° from the flat portion 15, or otherwise out of alignment such that the opening 12 is not pointed downward when the cup is resting on the flat portion 15. The front of the lid 2 may be higher or lower than the back of the lid 2, again to encourage the cup to tip onto its side if it lands or is placed upside down on its top.

The lid 2 may have a trough 16 adjacent the opening 12 such that liquid from within the cup must travel along the trough 16 to exit the cup via the opening 12. When the cup is upside down or on its side, this trough 16 may prevent liquid that has collected within the lid 2 behind the trough 16 from reaching the opening 12.

The lid 2 may have a vent hole 40 located opposite the opening 12 to allow air to enter the cup when the user is drinking or pouring liquid from the opening 12.

Figure 2:
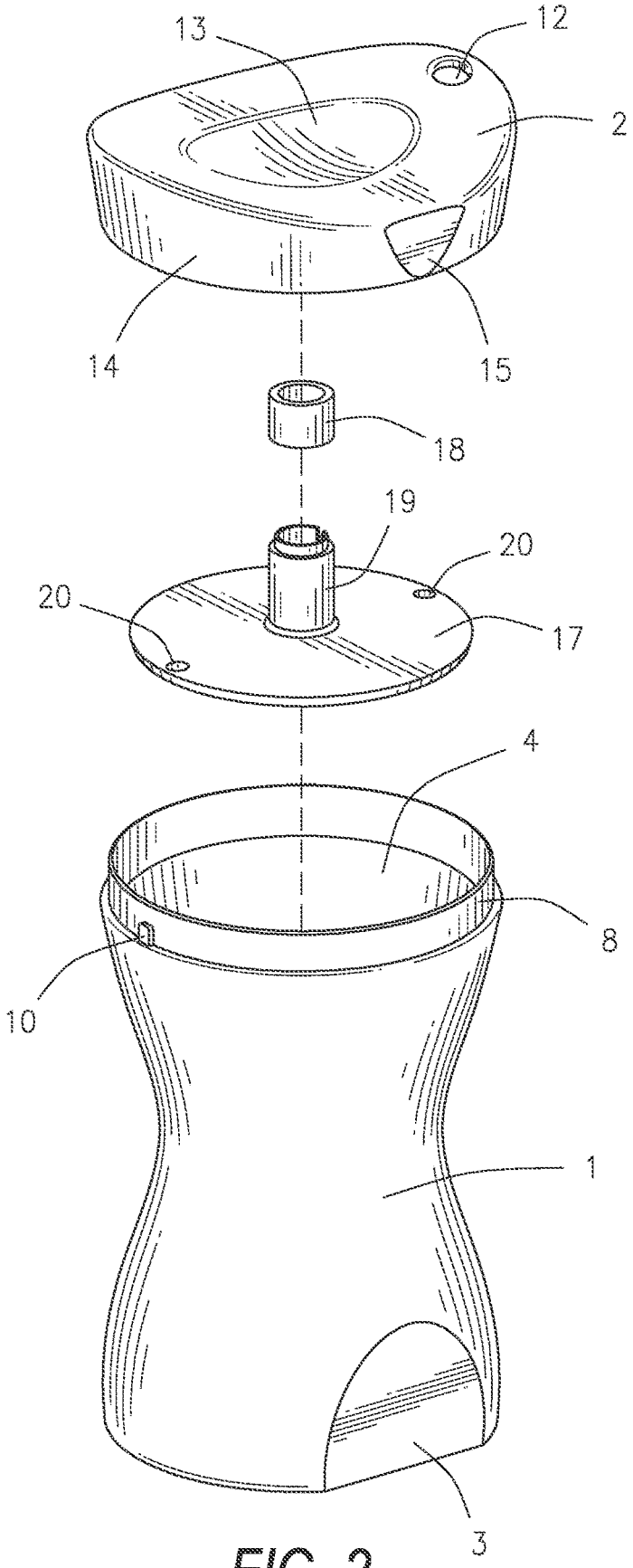
FIG. 2 is an exploded view of the spill resistant cup.
Figure 3:
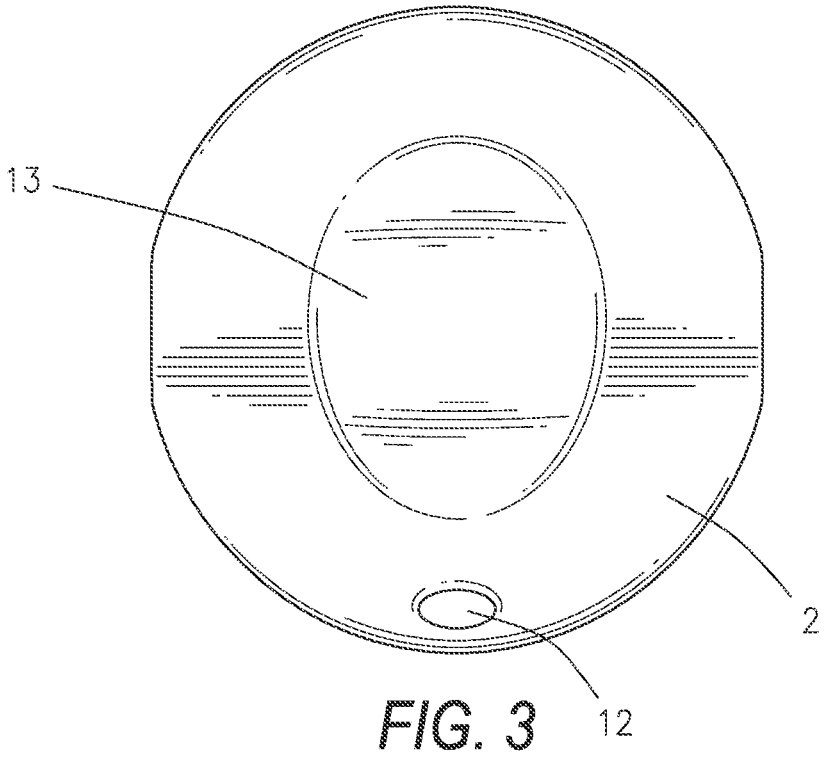
FIG. 3 is a top view of the spill resistant cup.

An insert 17 may be attached to and extend downward from the lid 2. The insert 17 may be attached to the lid 2 either permanently or removably via one or more elongate structures or assemblies. For example, as shown in FIG. 2, the insert 17 may be attached to the lid 2 via a single assembly comprising a first cylinder 18, which may be attached to the lid 2, and a second cylinder 19, which may extend upward from the insert 17. The second cylinder 19 may removably attach to the first cylinder 18, allowing the insert 17 to be easily removed for cleaning. Alternately, the insert 17 may attach to the lid 2 via a threaded circular structure, which may correspond to a threaded ring structure in the lid 2, allowing the insert 17 to threadedly attach to and detach from the lid 2. Alternately, the insert 17 may attach to the body 1.

The insert may extend into the body 1 and may be circular or other shape to match the shape of the interior of the body 1 at the point the insert 17 hits. The insert 17 may be sized such that it fits closely along the interior wall of the body 1, preventing liquid from traveling between the insert 17 and the wall of the body 1. The insert 17 may have one or more holes 20 therethrough. As shown in FIG. 2, one hole 20 may be aligned with the opening 12 in the lid 2, while a second hole 20 may be opposite the first hole 20, allowing air to travel from above the insert 17 to below the insert 17 when liquid is traveling through the hole 20 aligned with the opening 12. The second hole 20 may be smaller than the first hole 20 to minimize how much liquid can travel through the second hole 20 when the cup is dropped or tipped other than during proper use. Alternately, the hole 20 may be a single slit extending across the insert 17, as shown in FIG. 12. The slit design would allow liquid to travel through one end of the slit while air is vented through the opposite end of the slit. If the hole 20 is a slit, it may be parallel to the flat portion 15 or the plane in which the flat portion 15 lies, if the flat portion 15 is not flat, so that the hole 20 is not pointed downward when the cup is resting on the flat portion 15.

Alternately, the holes 20 may be elevated, as shown in FIGS. 13 through 19. This may allow a small amount of fluid that has traveled through the holes 20 but not exited the lid 2 to remain above the insert 17 even then the cup is returned to an upright position. The portion of the body 1 extending above the insert 17 may not be insulated, which may allow hot fluid remaining above the insert 17 to cool. This may be desirable when drinking hot beverages, as the user may allow their next sip to cool while keeping their remaining beverage hot. The holes 20 may be elevated on risers 36, as shown. In other words, the insert 17 may divide the body 1 into a lower chamber and an upper chamber, where liquid in the lower chamber may travel to the upper chamber through the hole 20 when the cup is tipped but may not return to the lower chamber when the cup is returned to the upright position due to the elevated nature of the holes 20.

The insert 17 may be substantially flat, as shown in FIG. 2, or may be angled, as shown in FIGS. 7 through 11. A hood 21 may extend upward from the insert 17 and/or riser 36 and over the first hole 20, preventing liquid splashing through the first hole 20 from traveling directly to the opening 12 in the lid 2, thus further preventing unwanted spills. The hood 21 may be open on its sides to allow liquid traveling through the first hole 20 to continue to the opening 12 when the cup is tipped intentionally. One or more posts 22 may extend downward from the insert 17 near the first hole 20 to prevent ice located within the cup from blocking the first hole 20 during use.

During use, a user may drink from the cup via the opening 12. As the user tips the cup to drink from the opening 12, liquid from within the body 1 may travel through the hole 20, along the trough 16, and out the opening 12 unimpeded, simulating the experience of drinking from a regular cup or glass. If the cup is tipped in any other direction, the amount of liquid that can travel through the holes 20 may be limited by their location. For example, if the cup is tipped on its side, no liquid can reach the holes 20 unless the cup is more than half full. If it is more than half full, the speed at which liquid can travel through the holes 20 may be limited because both holes will be covered with liquid, creating a weak vacuum. Any liquid that does travel through the holes 20 would then have to fill the space between the insert 17 and the lid 2 at least halfway to reach the opening 12, which may further limit the quantity and speed of liquid that ultimately spills. This may provide the user an opportunity to right the cup before liquid is spilled, or at least limit, if not entirely prevent, liquid from spilling from the cup if it is left on its side. The hood 21 may further limit the speed and quantity of unwanted spills. The shape of the cup may allow it to rest in this optimal side-lying position regardless of how it initially lands. The trough 16 may further impede the liquid from spilling when the cup is oriented other than for normal drinking, particularly if it lands or is placed upside down. The shape of the lid 2 may encourage the cup to fall on its side if placed upside down, but if not, the liquid must accumulate in the space between the insert 17 and the lid 2 at least as high as the length of the trough before liquid can reach the opening 12.

Whereas, the devices and methods have been described in relation to the drawings and claims, it should be understood that other and further modifications, apart from those shown or suggested herein, may be made within the spirit and scope of this invention.

What is claimed is:

1. A spill resistant cup comprising:

a hollow body with a top and a bottom, where the bottom of the body is closed and the top of the body is open;

a lid with a top and at least one side wall, where the lid is removably attached to the body such that the lid spans the top of the body and where the top of the lid has an opening; and an insert located between and spaced from the top of the lid and the bottom of the body such that the insert divides the body into a lower chamber with at least one side wall and an upper chamber with at least one side wall, where the insert has an elevated opening, the at least one side wall of the lower chamber is insulated, and the at least one side wall of the upper chamber is not insulated, such that, when the spill resistant cup is tipped, fluid located in the lower chamber is capable of flowing through the elevated opening into the upper chamber, but when the spill resistant cup is returned to an upright position, fluid located in the upper chamber below the elevated opening is incapable of returning to the lower chamber and where the elevated opening in the insert aligns with and is located on the same side as the opening in the lid.

2. The spill resistant cup of claim 1 where the body has one or more flat panels such that when the spill resistant cup tips over the spill resistant cup tends to rest on one of the one or more flat panels.

3. The spill resistant cup of claim 2 where the opening in the lid does not align with any of the one or more flat panels of the body.

4. The spill resistant cup of claim 1 where the body has a rim adjacent the top, the lid has a rim, and the lid removably attaches to the body via the two rims.

5. The spill resistant cup of claim 4 where the at least one sidewall of the lid comprises the rim of the lid.

6. The spill resistant cup of claim 4 where the rim of the body has threads and where the rim of the lid has corresponding threads such that the lid is capable of being screwed onto the body.

7. The spill resistant cup of claim 1 where the lid further comprises a vent hole.

8. The spill resistant cup of claim 1 where the insert further comprises a vent hole.

9. The spill resistant cup of claim 1 where the insert is removably attached to the lid.

10. The spill resistant cup of claim 1 further comprising a hood located between the elevated opening in the insert and the opening in the lid.

11. The spill resistant cup of claim 1 further comprising one or more posts extending downward from the insert.

12. A spill resistant cup comprising:

a closed vessel with an interior shape defining an interior space, where the vessel has a top and an opposing bottom, and where the vessel is shaped such that the vessel has one or more predictable landing positions, where a landing position is a position in which the spill resistant cup comes to rest when placed on a surface other than on the vessel's bottom;

an opening in the top of the vessel, where the opening is positioned such that the opening is not down when the spill resistant cup is in any of the one or more predictable landing positions; and an insert between the top and the bottom of the vessel such that the insert divides the vessel into an insulated lower chamber with at least one side wall, such that the at least one side wall is insulated throughout the insulated lower chamber, and an uninsulated upper chamber with at least one side wall, such that the at least one side wall is not insulated throughout the uninsulated upper chamber, where the insert has an elevated opening and where the insert has a perimeter matching the interior shape of the vessel at the location of the insert such that liquid cannot travel past the insert other than through the elevated opening in the insert, such that, when the spill resistant cup is tipped, fluid located in the insulated lower chamber is capable of flowing through the elevated opening into the uninsulated upper chamber, but when the spill resistant cup is returned to an upright position, fluid located in the uninsulated upper chamber below the elevated opening is incapable of returning to the insulated lower chamber; and where the elevated opening in the insert aligns with and is located on the same side as an opening in a lid.

13. A spill resistant cup comprising:

a hollow body with a top and a bottom;

an insert located between and spaced from the top and the bottom of the body, such that the insert divides the body into a lower chamber with at least one side wall and an upper chamber with at least one side wall, where the at least one side wall of the lower chamber is insulated and the at least one side wall of the upper chamber is not insulated; and at least one elevated opening in the insert, such that liquid in the lower chamber travels to the upper chamber when the spill resistant cup is tipped and is retained in the upper chamber when the cup is returned to an upright position; and where the elevated opening in the insert aligns with and is located on the same side as an opening in a lid.

* * * * *